US009083069B2

(12) United States Patent
Iio

(10) Patent No.: US 9,083,069 B2
(45) Date of Patent: Jul. 14, 2015

(54) POWER COMBINER/DISTRIBUTOR, POWER AMPLIFYING CIRCUIT, AND WIRELESS APPARATUS

(71) Applicant: FURUNO Electric Co., Ltd., Nishinomiya, Hyogo-Pref (JP)

(72) Inventor: Kenichi Iio, Nishinomiya (JP)

(73) Assignee: FURUNO ELECTRIC COMPANY LIMITED, Hyogo (JP)

( * ) Notice: Subject to any disclaimer, the term of this patent is extended or adjusted under 35 U.S.C. 154(b) by 309 days.

(21) Appl. No.: 13/653,608

(22) Filed: Oct. 17, 2012

(65) Prior Publication Data

US 2013/0093535 A1 Apr. 18, 2013

(30) Foreign Application Priority Data

Oct. 18, 2011 (JP) ..... 2011-228755

(51) Int. Cl.
*H01P 5/12* (2006.01)
*H01P 5/19* (2006.01)

(52) U.S. Cl.
CPC ..... *H01P 5/19* (2013.01)

(58) Field of Classification Search
CPC ..... H01P 5/19; H01P 5/12; H01P 1/181; H01P 1/182
USPC ..... 333/113, 114, 137, 239, 248
See application file for complete search history.

(56) References Cited

U.S. PATENT DOCUMENTS 4,686,493 A 8/1987 Chang et al.
5,473,294 A * 12/1995 Mizzoni et al. ..... 333/113

FOREIGN PATENT DOCUMENTS

JP 2592476 B2 3/1997

* cited by examiner

*Primary Examiner* — Robert Pascal
*Assistant Examiner* — Kimberly Glenn
(74) *Attorney, Agent, or Firm* — Global IP Counselors, LLP

(57) ABSTRACT

A power combiner/distributor including first, second, and third waveguides connected with each other in a planar shape, and for either one of distributing power inputted from the first waveguide to the second and third waveguides and combining powers inputted from the second and third waveguides to input the combined power to the first waveguide is provided. The power combiner/distributor includes a branch circuit connected with the first waveguide and for branching a transmission path formed in the first waveguide into first and second transmission paths, and decoupling circuits connected with the branch circuit and also to the second and third waveguides, respectively, the decoupling circuits having a power losing resonator coupled to the second and third waveguides, resonating within an operation frequency band, and causing a power loss.

7 Claims, 17 Drawing Sheets

POWER COMBINER/DISTRIBUTOR, POWER AMPLIFYING CIRCUIT, AND WIRELESS APPARATUS

CROSS-REFERENCE TO RELATED APPLICATION(S)

The application claims priority under 35 U.S.C. §119 to Japanese Patent Application No. 2011-228755, which was filed on Oct. 18, 2011, the entire disclosure of which is hereby incorporated by reference.

TECHNICAL FIELD

The present invention generally relates to a power combiner/distributor to be used within a microwave band or a millimeter wave band, a power amplifying circuit and a wireless apparatus equipped with the combiner/distributor.

BACKGROUND OF THE INVENTION

For power combiners that combine a plurality of microwave powers, it is desired that powers are inputted thereto in the same phase to be able to be combined. Moreover, branch ports of such power combiners are desired to have a high isolation property from each other so as to prevent interference between circuits connected to the branch ports, respectively.

As power combiners using striplines, there exists a Wilkinson power distributor. With the Wilkinson power distributor, although it has in-phase distribution and high isolation properties, it has low power durability, causing a problem that it cannot be used with a large power.

As power combiner/distributors using waveguides, a MAGIC-T model has often been used. However, because the MAGIC-T model has a three dimensional shape, it has a complicated structure, causing difficulties in reducing in cost and size and securing the isolation between output ports.

Further, power combining and distribution can be performed by using the conventional waveguide directional couplers. However, when a signal is inputted from a first input port to be distributed to first and second output ports P2 and P3, a relative phase difference between the distributed output signals is 90°; therefore, when the signals are to be used in a combining circuit, a shaft length of a waveguide for the first output port P2 is required to be set longer by ¼ of a guide wavelength than that of a waveguide for the second output port P3 so as to correct 90° of the phase difference. Therefore, a distribution phase variance is caused by influence of frequency properties of the wavelengths of the waveguides, causing a difficulty in obtaining satisfactory distribution properties over a wide band.

JP2592476B discloses a waveguide hybrid coupler. FIG. 17A is a cross-sectional view of a hybrid coupler 10 disclosed in JP2592476B, and FIG. 17B is a cross-sectional plan view taken along a line B-B in FIG. 17A. The hybrid coupler 10 is formed with a first waveguide 12 and a second waveguide 14. Each waveguide has a rectangular cross-section part of which a ratio between the longer wall and the shorter wall is 2:1. The hybrid coupler 10 has two functions: a hybrid coupling function and a phase correcting function for the electromagnetic energy between the two waveguides 12 and 14. A coupling gate 24 arranged in a common side wall 22 has a fixed length substantially the same as a wavelength of one free space of the electromagnetic energy in a longitudinal axis of either one of the waveguides 12 and 14.

Moreover, by arranging the coupling gate 24 in the common side wall of the two waveguides 12 and 14, a hybrid coupler with short slots formed orthogonal to the side wall is configured. A microwave signal coupling between the two waveguides via the gate 24 receives a phase shift by 90° of lag.

Thus, a necessary phase correction is performed by using a set of four capacitive irises 36 arranged in the first waveguide 12 on the side of a penetration port 26 from the gate 24 and a set of four inductive irises 38 arranged in the second waveguide 14 on the side of a coupling port 28 from the gate 24. The capacitive irises 36 in the waveguide 12 configure a phase shifter 40 for causing a phase shift by 45° of lag at the penetration port 26. The inductive irises 38 in the waveguide 14 configure a phase shifter 42 for causing a phase shift by 45° of lead at the coupling port 28. The phase of the signal shifted by 45° through the phase shifter 42 and then by −90° through the gate 24 matches with the phase of the signal shifted by −45° through the phase shifter 40.

The waveguide hybrid coupler disclosed in JP2592476B has a structure in which the plurality of capacitive irises are provided in one of the waveguides to project from its wider face and the plurality of inductive irises are provided in the other waveguide to project from its narrower face. Thus, the entire structure of the unit is complicated, and it has been difficult to fabricate the unit.

SUMMARY OF THE INVENTION

The present invention is made in view of the above situation, and generally aims to provide a power combiner/distributor that is reduced in size and cost by being configured in a planar shape and has a symmetric structure to be able to distribute in-phase, a power amplifying circuit and a wireless device equipped with the combiner/distributor.

The power combiner/distributor of the present invention uses, in its part, a resonator with larger loss compared to other components therein without using a terminator having a function of absorbing all the inputted radio waves, and thus, it can be configured in a planar shape even though it is a waveguide, an in-phase distribution can be performed by having a symmetric shape, and an isolation between distribution ports can be secured.

Specifically, in the waveguide circuit, a resonator with low no-load Q value and low loss is arranged between two distribution ports which the isolation is required. A further specific configuration is as follows.

(1) According to an aspect of the invention, a power combiner/distributor including first, second, and third waveguides (WG1, WG2 and WG3) connected with each other in a planar shape, and for either one of distributing power inputted from the first waveguide to the second and third waveguides and combining powers inputted from the second and third waveguides to the first waveguide is provided. The power combiner/distributor includes a branch circuit (combination of R11, R12, and R13) connected with the first waveguide and for branching a transmission path formed in the first waveguide into first and second transmission paths (CC1 and CC2), and decoupling circuits (R22, R33, and RL) connected (indirectly) with the branch circuit and also to the second and third waveguides, respectively, the decoupling circuits having a power losing resonator (RL=R23+Re) coupled to the second and third waveguides, resonating within an operation frequency band, and causing a power loss.

(2) The power losing resonator may include a resistor (Re) for acting on either one of an electric field and a magnetic field in the waveguide to cause the loss, or includes the resistor and a resonant cavity (R23).

(3) The first transmission path may be connected between the power losing resonator and the second waveguide and formed with at least one resonant cavity (R22) coupled to the power losing resonator and the second waveguide. The second transmission path may be connected between the power losing resonator and the third waveguide and formed with at least one resonant cavity (R33) coupled to the power losing resonator and the third waveguide.

(4) The branch circuit may be formed with a resonant cavity (R12) connected with the first transmission path and coupled to a branching resonant cavity (R11), and another resonant cavity (R13) connected with the second transmission path and coupled to the branching resonant cavity.

(5) An electromagnetic wave that propagates in the second waveguide may have the same phase as an electromagnetic wave that propagates in the third waveguide, coupling degrees of the power losing resonator with the second and third waveguides and a Q value of the power losing resonator may be determined so that an amount of the electromagnetic wave that leaks from the second waveguide to the third waveguide and an amount of the electromagnetic wave that leaks from the third waveguide to the second waveguide are −10 dB or below, respectively.

(6) According to another aspect of the invention, a power amplifying circuit is provided. The circuit includes the power combiner/distributor described as above in any one of (1) to (5), the combiner/distributor configuring either one of a power distributor for distributing an input signal to a plurality of power amplifiers and a power combiner for combining output signals from a plurality of power amplifiers.

(7) According to another aspect of the invention, a wireless apparatus is provided. The apparatus includes a circuit for distributing or combining communication signals and provided with the power combiner/distributor described as above in any one of (1) to (5).

According to the above aspects of the invention, a radio wave inputted from the first waveguide can be distributed in-phase to be outputted within a wide frequency band, and a good reflection property, an excellent low loss property, and a high isolation property can be obtained at the same time.

BRIEF DESCRIPTION OF THE DRAWINGS

The present disclosure is illustrated by way of example and not by way of limitation in the figures of the accompanying drawings, in which the like reference numeral indicate like elements and in which.

DETAILED DESCRIPTION

First Embodiment

Figure 1:
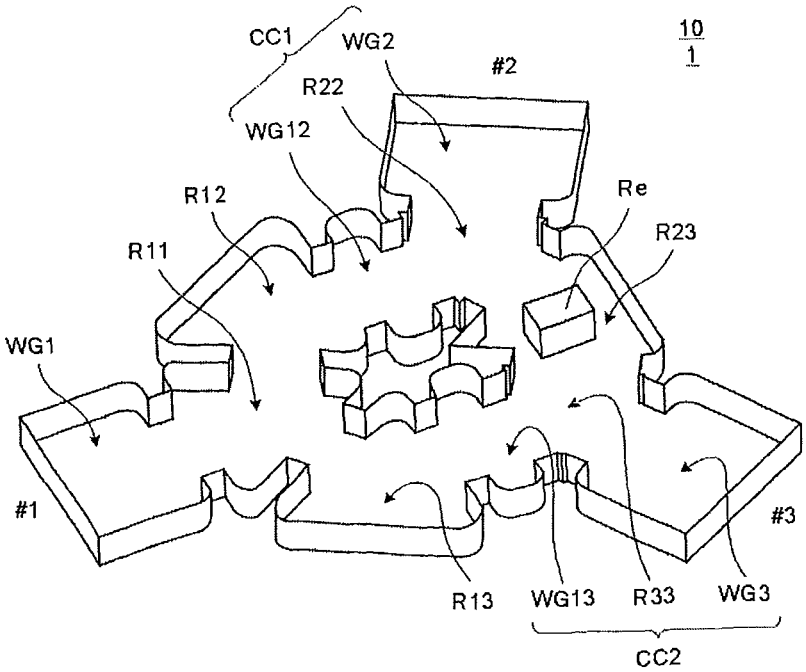
FIG. 1 is a perspective view of a main part of a power combiner/distributor 101 according to a first embodiment of the present invention.
Figure 2:
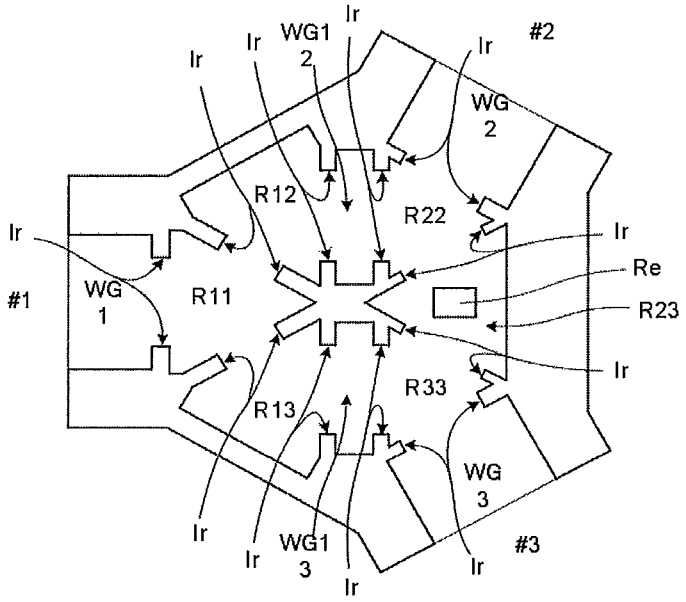
FIG. 2 is a plan view of the power combiner/distributor 101.

A power combiner/distributor of the first embodiment is described with reference to FIGS. 1 to 10. FIG. 1 is a perspective view of a main part of a power combiner/distributor 101. Further, FIG. 2 is a plan view of the power combiner/distributor 101 without an upper metal plate. Note that, FIG. 1 only shows a spatial shape such as inside a waveguide. The power combiner/distributor 101 has a first metal plate forming the space, such as inside the waveguide, and a second metal plate covering the space by overlapping with the first metal plate. FIG. 2 illustrates the first metal plate.

The power combiner/distributor 101 includes a first waveguide WG1, a second waveguide WG2, and a third waveguide WG3. When the first waveguide WG1 is referred to as a first port, the second waveguide WG2 is referred to as a second port, and a third waveguide WG3 is referred to as a third port, the power combiner/distributor 101 either distributes a power inputted from the first port #1 to the second port #2 and the third port #3 or combines powers inputted from the second port #2 and the third port #3 and outputs it to the first port #1. The waveguides WG1, WG2, and WG3 are arranged on the same plane.

The power combiner/distributor 101 is formed with a branching resonant cavity R11 coupling to a resonant cavity R12 and a resonant cavity R13, and also to the first waveguide WG1. The resonant cavities R12, R13 and the branch resonant cavity R11 configure a branch circuit.

Moreover, the power combiner/distributor 101 is formed with a resonant cavity R22 coupling to the second waveguide WG2 and a resonant cavity R33 coupling to the third waveguide WG3. The resonant cavities R12 and R22 are connected with each other via the waveguide WG12. Similarly, the resonant cavities R13 and R33 are connected with each other via the waveguide WG13. The waveguide WG12, the resonant cavity R22, and the waveguide WG2 configure a first transmission path CC1, and the waveguide WG13, the resonant cavity R33, and the waveguide WG3 configure a second transmission path CC2.

Further, the power combiner/distributor 101 is formed with a resonant cavity R23 coupling to the second waveguide WG2 and the third waveguide WG3, for resonating within an operation frequency band, and includes a resistor Re arranged within the resonant cavity R23. The resonant cavity R23 and the resistor Re configure a power losing resonator. The resistor Re is obtained by sintering silicon carbide (SiC) particles into a cuboid shape having the same height as the resonant cavity R23. The resistor Re functions on the resonator with a relative permittivity ∈r=around 12, a large tanδ value, and a small Q value obtained because of the resonant cavity R23 and the resistor Re. The resistor Re is arranged at the center of the resonant cavity R23 where an electric field intensity is high, and it is mainly coupled to the electric field to generate ohmic loss. The resistor Re is also coupled to a magnetic field to generate ohmic loss. Therefore, the power losing resonator attenuates the signal that is to be propagated from the second waveguide WG2 to the third waveguide WG3 or from the third waveguide WG3 to the second waveguide WG2 via the resonate cavity R23.

A waveguide iris (hereinafter, simply referred to as "the iris") Jr is formed between the first waveguide WG1 and the branching resonant cavity R11 to function as a window for determining a coupling degree. Similarly, irises Jr are formed between the branching resonant cavity R11 and the resonant cavity R12 and between the branching resonant cavity R11 and the resonant cavity R13. Moreover, irises Jr are formed between the resonant cavity R12 and the waveguide WG12 and between the waveguide WG12 and the resonant cavity R22. Similarly, irises Ir are formed between the resonant cavity R13 and the waveguide WG13 and between the waveguide WG13 and the resonant cavity R33. Moreover, irises Ir are formed between the resonant cavity R22 and the waveguide WG12 and between the resonant cavity R22 and the resonant cavity R23. Similarly, irises Ir are formed between the resonant cavity R33 and the waveguide WG3 and between the resonant cavity R33 and the resonant cavity R23. The resonant space is divided by these irises, and the coupling degrees between the adjacent resonant cavities and between each cavity and the adjacent waveguide thereto are determined by the irises, respectively.

Figure 3:
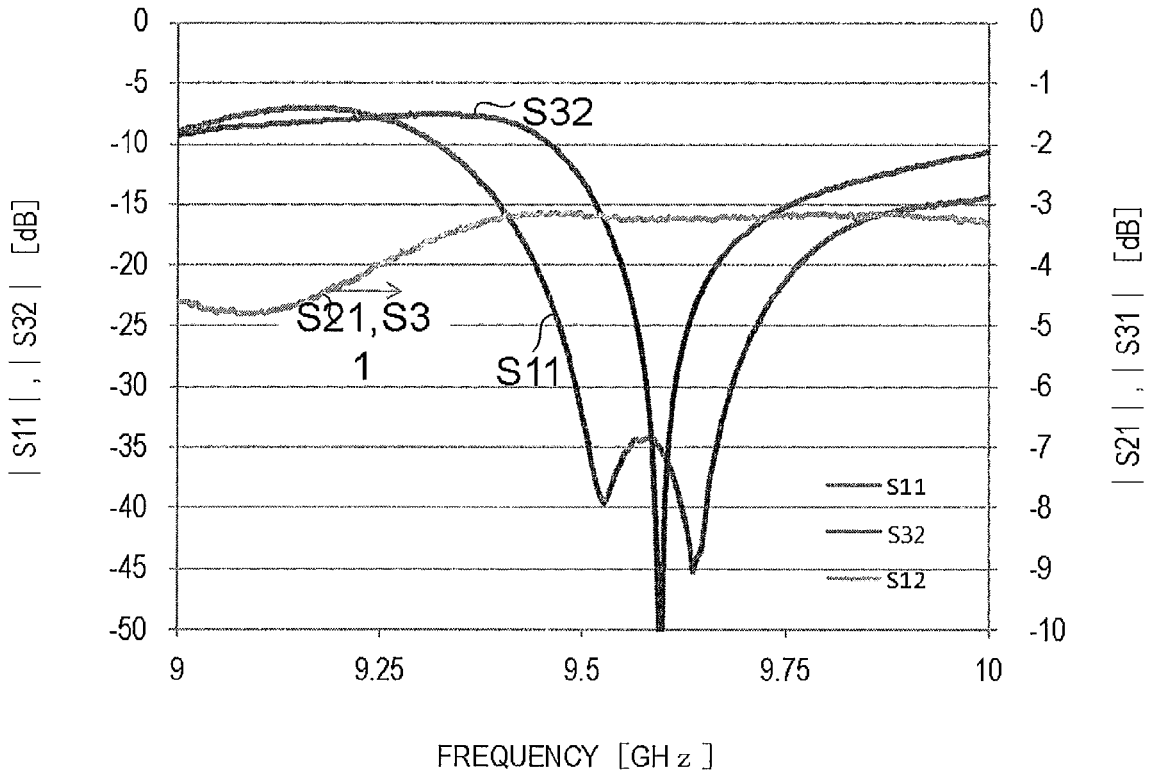
FIG. 3 is a graph illustrating frequency properties of the power combiner/distributor 101.

FIG. 3 is a graph illustrating frequency properties of the power combiner/distributor 101. Here, S11 indicates a reflection property seen from the port #1. S21 indicates a passing property (distributive property) from the port #1 to the port #2, and S31 indicates a passing property (distributive property) from the port #1 to the port #3. S32 indicates a passing property (decoupling property) from the port #3 to the port #2. The power combiner/distributor 101 is formed into a symmetric shape with respect to an electromagnetic wave propagation direction of the first waveguide WG1, and thus, S21 and S31 have the same property.

The resonant frequency of the resonant cavities R12, R22, R13, R33, and R23 is 9.75 GHz.

Thus, the signal is distributed at −3 dB over a wide band centering on the frequency of 9.75 GHz, and a high decoupling property of approximately −40 dB or below is obtained. Moreover, also for the reflection property seen from the port #1 (S11), a low reflection property of −30 dB or below is obtained.

Next, the function of the power combiner/distributor 101 of the first embodiment is described.

Figure 4:
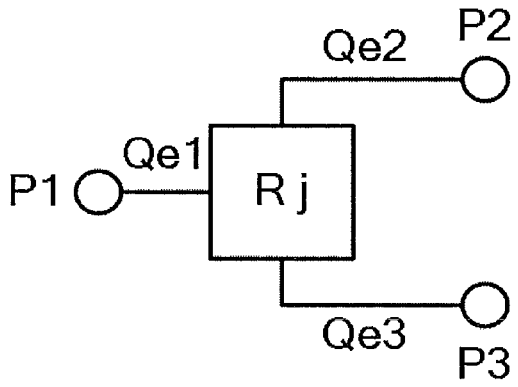
FIG. 4 is a fundamental equivalence circuit of a power distributing circuit part of the power combiner/distributor 101.

First, a fundamental equivalence circuit of a power distributing circuit part of the power combiner/distributor 101 is illustrated in FIG. 4. In the power distributing circuit, an input terminal P1 and output terminals P2 and P3 are connected with each other via a resonator Rj (referred to as the junction resonator here since it is used particularly for the connecting). Here, when a coupling amount between the junction resonator Rj with each of the terminals P1, P2, and P3 is expressed by using external Q: Qe1, Qe2, and Qe3 respectively, an input matching condition of the terminal P1 is as follows.

$$1/Qe1=(1/Qe2)+(1/Qe3) \quad (1)$$

Next, when a power distribution ratio between the terminals P2 and P3 is n:1, the following relation is established between each coupling coefficient and a scattering parameter.

$$|S21|^2/|S31|^2=Qe3/Qe2=n \quad (2)$$

As a result, Qe2 and Qe3 that give a desired distribution ratio are expressed by the following equations.

$$Qe2=\{(1+n)/n\}Qe1,\ Qe3=(1+n)Qe1 \quad (3)$$

Figure 5:
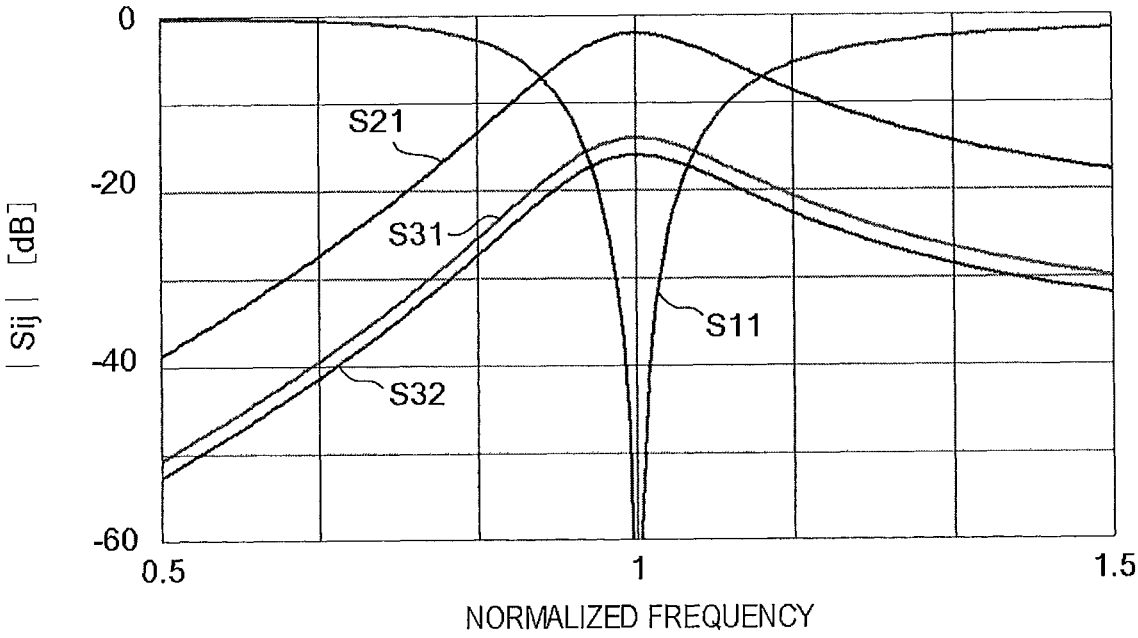
FIG. 5 is a calculation result of frequency properties by the fundamental equivalent circuit in FIG. 4.

For example, when the power distribution ratio is 4:1 and the external Q of the terminal P1 is Qe1=100, the external Q becomes Qe2=125 and Qe3=500 based on Equations 3. A calculation result of the frequency property by the fundamental equivalent circuit is illustrated in FIG. 5. In FIG. 5, the lateral axis is a normalized frequency, and the normalized frequency=1 corresponds to the operation frequency.

As above, the junction resonator of 1-input/2-output functions as a power combining circuit; however, it has a narrow band. Therefore, the junction resonator is used as a part of a filter to widen the band of the filter.

Figure 6A:
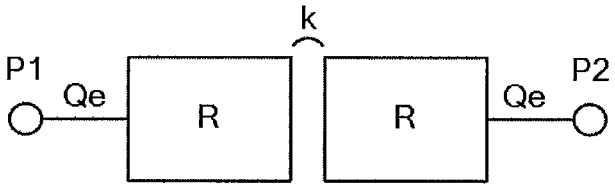
FIG. 6A is a diagram illustrating an equivalent circuit of a two stage filter.
Figure 6B:
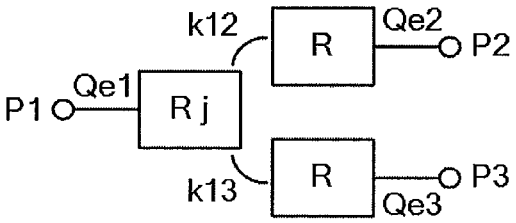
FIG. 6B is a diagram illustrating an equivalent circuit branched into two at a coupling part between resonators.

FIG. 6A illustrates an equivalent circuit of a fundamental two stage filter. The filter is branched into two at a coupling part between the resonators as illustrated in FIG. 6B so as to widen the band.

Here, the matching condition of the terminal P1 is expressed by the following equation in comparison to a designing parameter of the fundamental filter circuit.

$$k^2=k_{12}^2+k_{13}^2 \quad (4)$$

Moreover, when the power distribution ratio between the terminals P2 and P3 is n:1, the following relation is established between each coupling coefficient and the scattering parameter.

$$|S21|^2/|S31^2=k_{12}^2/k_{13}^2=n \quad (5)$$

Therefore, each parameter is unambiguously obtained as follows.

$$k12=\sqrt{\{n/(n+1)\}}k,\ k13=\{1/\sqrt{(n+1)}\}k \quad (6)$$

Here, the external Q (Qe) is defined as follows.

$$Qe1=Qe2=Qe3=Qe \quad (7)$$

By setting the circuit parameters as above, the input power from the terminal P1 is distributed to the terminals P2 and P3 to be outputted therefrom.

Here, a two-way distributor based on the two stage filter of which a center frequency is 9.5 GHz, a band is 800 MHz, and a ripple is 0.1 dB is designed. The designing parameters used here are indicated by Equations 8.

$$k=11.6\%,\ Qe=10.0 \quad (8)$$

Based on this filter, a power distributor in which the distribution to the terminals P2 and P3 is 1:1 is designed. Each parameter has the following value based on Equations 6, 7, and 8.

$$k_{12}=k_{13}=8.2,\ Qe=10.0 \quad (9)$$

Figure 7:
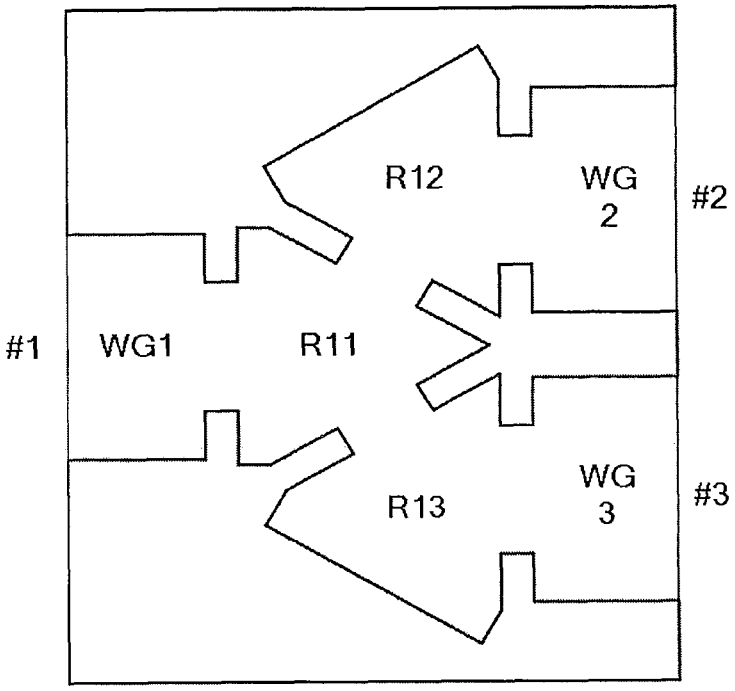
FIG. 7 is a plan view of a model of the equivalent circuit in FIG. 6B designed with a waveguide circuit (H-plane pattern)

Next, a branch circuit is designed by a waveguide circuit. FIG. 7 is a plan view of a model of designing the branch circuit (H-plane pattern). This model is the power combiner/distributor 101 illustrated in FIG. 2 without the resonant cavities R22 and R33 and the waveguides WG12 and WG13. The first waveguide WG1 is connected with the triangleshaped resonant cavity R11 (junction resonator). The two outputs of the resonant cavity R11 are electromagnetically coupled to the resonant cavities R12 and R13, respectively. Further, the resonant cavities R12 and R13 are connected with the waveguides WG2 and WG3, respectively. Between each resonant cavity and the adjacent waveguide thereto and between the adjacent resonant cavities are connected via the irises, and each coupling amount therebetween is set to the coupling coefficient and the external Q that are given by Equation 9.

Figure 8:
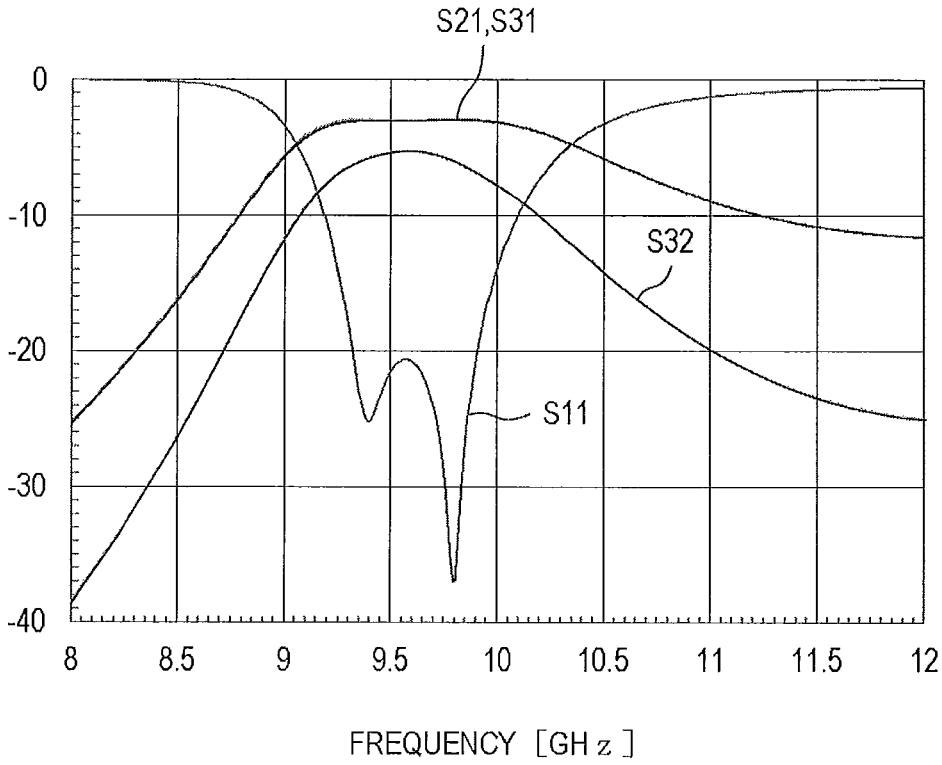
FIG. 8 is a graph illustrating the frequency properties of the model in FIG. 7.

FIG. 8 is a graph illustrating a frequency property of the model illustrated in FIG. 7. It can be seen that the input from the port #1 is equally distributed to the ports #2 and #3. Note that, the isolation between the ports #2 and #3 is about −6 dB at 9.5 GHz.

In order to prevent interference between machines connected with the power combiner/distributor, the power combiner/distributor requires a sufficient isolation between the ports. Therefore, here, a circuit is added to the model of FIG. 7 to secure the isolation.

Figure 9:
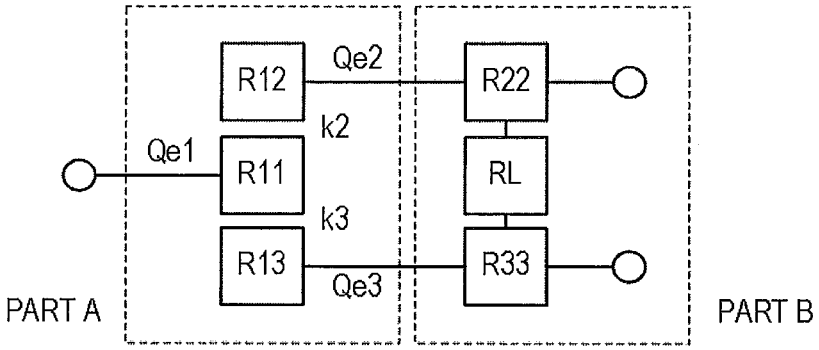
FIG. 9 is an equivalent circuit diagram of the power combiner/distributor 101.

FIG. 9 is an equivalent circuit diagram of the power combiner/distributor 101. The equivalent circuit in FIG. 9 is configured with the branch circuit (part A) illustrated in FIG. 6B and a decoupling circuit (part B) for obtaining a high isolation. The decoupling circuit (B part) is based on a fundamental of a method for high isolation of a Wilkinson power distributor, of which features are described as follows.

Figure 10:
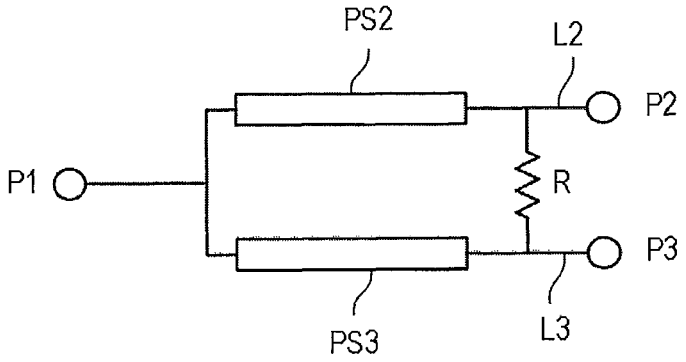
FIG. 10 is an equivalent circuit diagram of a Wilkinson power distributor.

FIG. 10 is an equivalent circuit diagram of the Wilkinson power distributor. In the Wilkinson power distributor, each of the phase shifters PS2 and PS3 is normally configured with a transmission path with ¼ of wavelength so that the power that propagates between the terminals P2 and P3 via the phase shifters PS2 and PS3 is shifted to overlap in a reversed phase at the destination terminal (either one of the terminals PS2 and PS3). However, with the power combiner/distributor 101 of this embodiment, three resonators (R11, R12, and R13) interpose between the ports #2 and #3, and therefore, the ports #2 and #3 have a reversed phase relation. Therefore, the phase shifters PS2 and PS3 configured with, for example, the transmission lines are not required.

Moreover, the part with the resistor R in the Wilkinson power distributor in FIG. 10 is difficult to manufacture with the waveguide; however, in this embodiment, it is replaced with the resonator. In other words, the power losing resonator configured by the resonant cavity R23 and the resistor Re in FIGS. 1 and 2 covers the function of the resistor R in the Wilkinson power distributor. This is one of the distinctive features of this embodiment.

With the Wilkinson power distributor, the parts where the resistor R interacts with a line L2 and a line L3 are branched into T-shape; however, if the T-shape branches are formed in the waveguide, non continuous parts will be created, causing a change in distribution ratio. Therefore, in this embodiment, the junction resonator is configured alternative to the T-shape branch. In other words, the resonant cavities R22 and R33 in FIGS. 1 and 2 cover the function of the T-shape branches, respectively.

The power combiner/distributor 101 functions based on the fundamental described above, and thus, a waveguide power combiner/distributor can be obtained in which the electromagnetic waves that propagate in the second and third waveguides WG2 and WG3 have the same phase and the amount of the electromagnetic wave that leaks from the second waveguide WG2 to the third waveguide WG3 and the amount of the electromagnetic wave that leaks from the third waveguide WG3 to the second waveguide WG2 are −10 dB or below.

When the isolation between the ports #2 and #3 is −10 dB or below, it can be used as a power combiner/distributor having a practically sufficient decoupling property. The isolation can be defined by the coupling degrees of the power losing resonator with the second waveguide WG2 and the third waveguide WG3 and the Q value of the power losing resonator.

Second Embodiment

Figure 11:
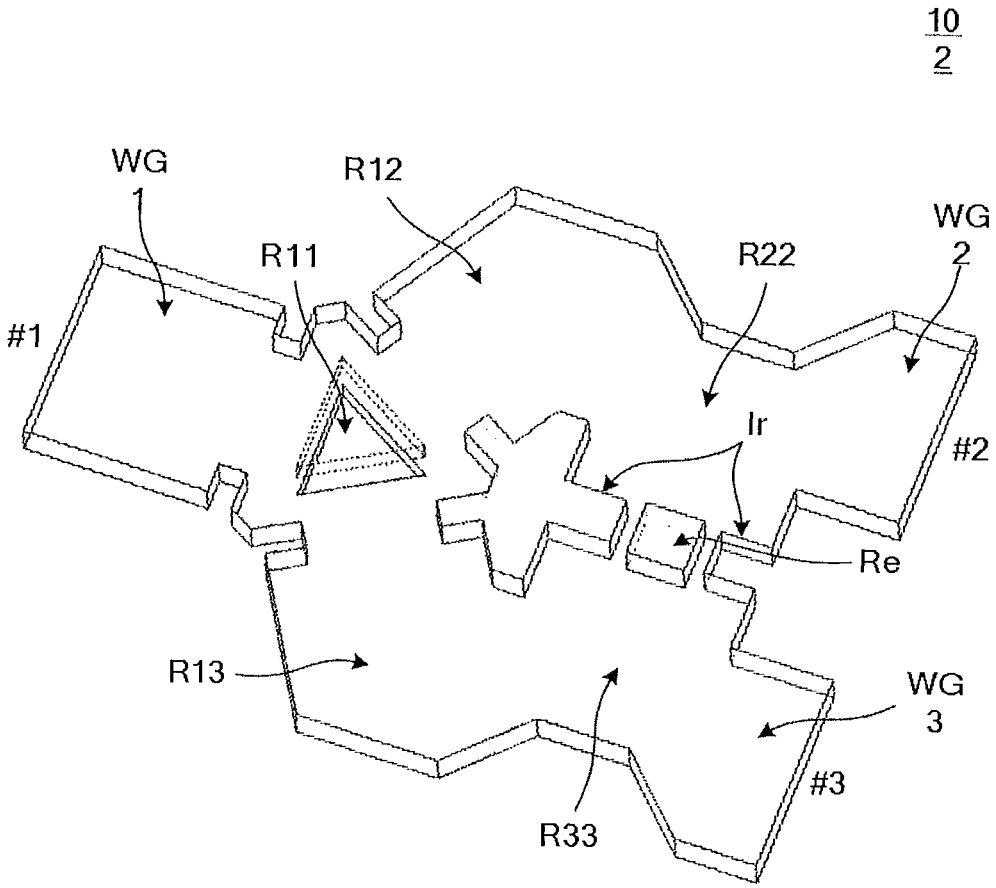
FIG. 11 is a perspective view of a main part of a power combiner/distributor 102 according to a second embodiment of the present invention.

FIG. 11 is a perspective view of a main part of a power combiner/distributor 102 of a second embodiment. Note that, FIG. 11 only shows a spatial shape such as inside a waveguide.

The power combiner/distributor 102 includes a first waveguide WG1, a second waveguide WG2, and a third waveguide WG3. When the first waveguide WG1 is referred to as a first port, the second waveguide WG2 is referred to as a second port, and a third waveguide WG3 is referred to as a third port, the power combiner/distributor 102 either distributes a power inputted from the first port #1 to the second port #2 and the third port #3 or combines powers inputted from the second port #2 and the third port #3 and outputs it to the first port #1. The waveguides WG1, WG2, and WG3 are arranged on the same plane.

The power combiner/distributor 102 is formed with a branching resonant cavity R11 coupling to a resonant cavity R12 and a resonant cavity R13, and also to the first waveguide WG1. The resonant cavities R12 and R13 and the branching resonant cavity R11 configure a branch circuit.

A triangle section at the center of the branching resonant cavity R11 is higher (thicker) than other parts. Thus, the center of the resonant space is recessed in both top and bottom surfaces. In this manner, the resonant frequency of the resonator can be increased to a predetermined frequency. In other words, generally, when a line is connected to a resonator, a resonant frequency is reduced by an inductance component of the connection part. Therefore, the plan size of the resonator is required to be reduced in advance so as to resonate at the predetermined frequency. Moreover, with the design of the circuit of this embodiment, because the band is desired to be wide and a strong bond is required between the lines, the size of the resonator is significantly reduced. However, if the plan size of the resonator is excessively small, the connection parts with the lines cannot be formed. Therefore, by increasing the height of the center of the resonator (in the section with high electric field intensity), the resonant frequency is increased and, thus, the resonator can be formed to have an appropriate plan dimension.

Moreover, the power combiner/distributor 102 is formed with a resonant cavity R22 coupling to the second waveguide WG2 and a resonant cavity R33 coupling to the third waveguide WG3. The resonant cavity R22 and the waveguide WG2 configure a first transmission path CC1, and the resonant cavity R33 and the waveguide WG3 configure a second transmission path CC2.

A resistor Re is arranged in a part with an iris Ir between the resonant cavities R22 and R33. The resistor Re functions as a power losing resonator as it is. Therefore, the power losing resonator attenuates a signal that is to be propagated from the second waveguide WG2 to the third waveguide WG3 or from the third waveguide WG3 to the second waveguide WG2 via the iris Ir.

Figure 12:
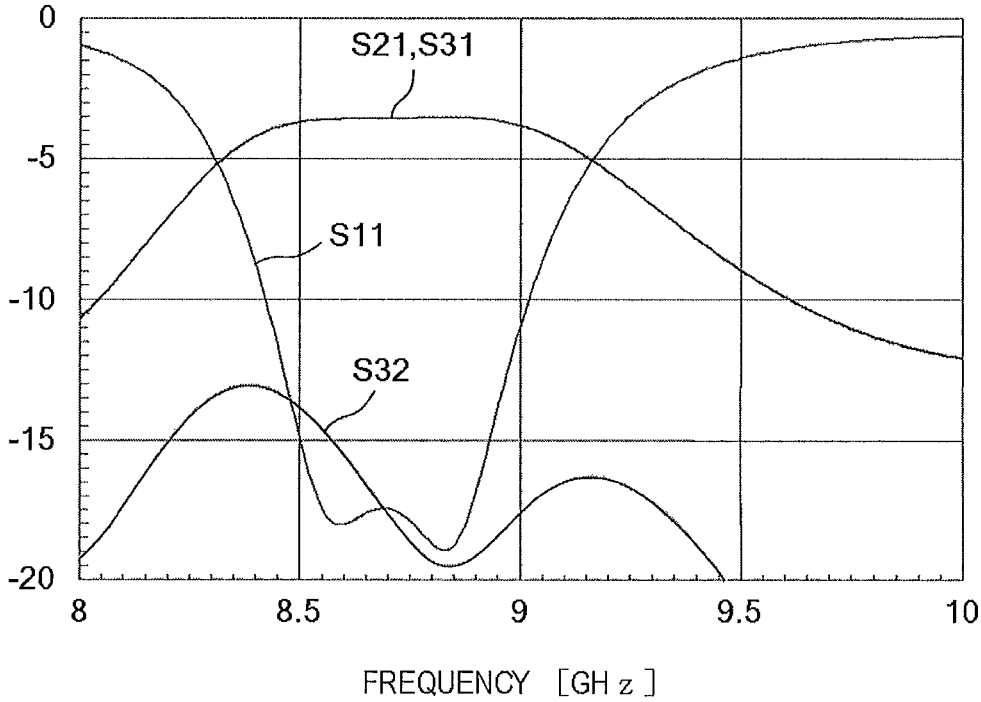
FIG. 12 is a graph illustrating frequency properties of the power combiner/distributor 102.

FIG. 12 is a graph illustrating frequency properties of the power combiner/distributor 102. Here, S11 indicates a reflection property seen from the port #1. S21 indicates a passing property (distributive property) from the port #1 to the port

#2, and S31 indicates a passing property (distributive property) from the port #1 to the port #3. S32 indicates a passing property (decoupling property) from the port #2 to the port #3. The power combiner/distributor 102 is formed into a symmetric shape with respect to an electromagnetic wave propagation direction of the first waveguide WG1, and thus, S21 and S31 have the same property. Thus, it can be seen that the input from the port #1 is equally distributed to the ports #2 and #3. Moreover, the isolation between the ports #2 and #3 is −19 dB at 8.5 GHz, and a sufficient decoupling property is obtained.

Third Embodiment

Figure 13:
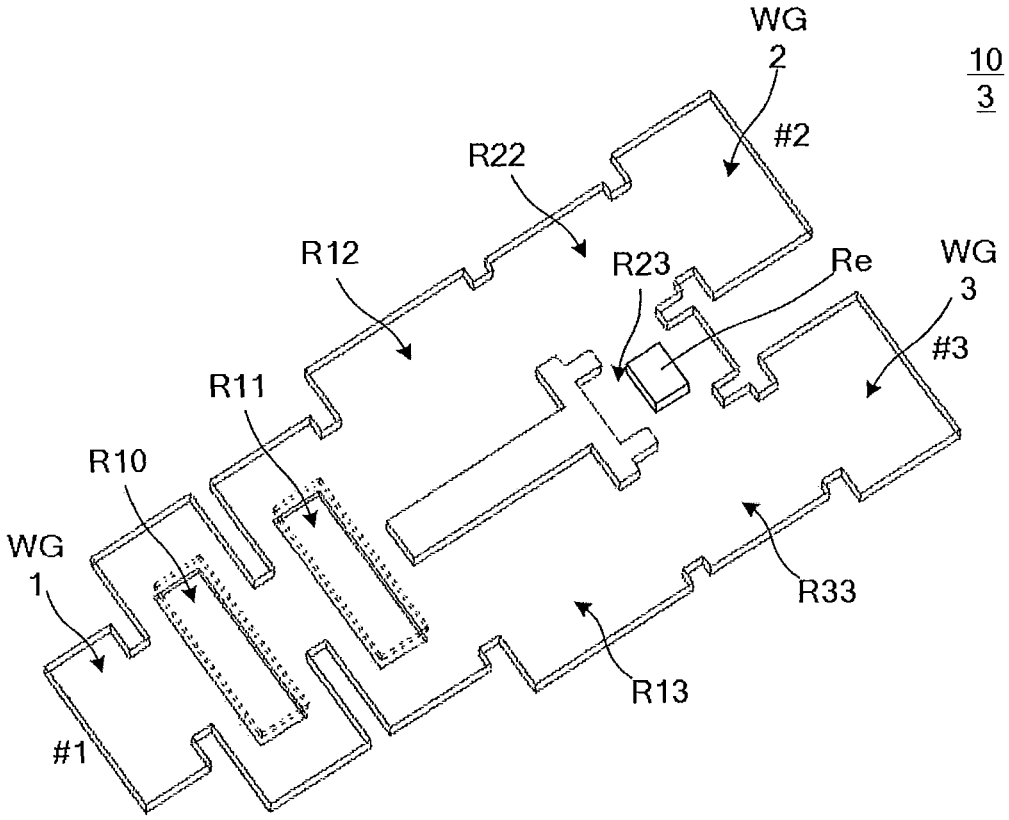
FIG. 13 is a perspective view of a main part of a power combiner/distributor 103 according to a third embodiment of the present invention.

FIG. 13 is a perspective view of a main part of a power combiner/distributor 103 of a third embodiment. Note that, FIG. 13 only shows a spatial shape such as inside a waveguide.

The power combiner/distributor 103 includes a first waveguide WG1, a second waveguide WG2, and a third waveguide WG3. When the first waveguide WG1 is referred to as a first port, the second waveguide WG2 is referred to as a second port, and a third waveguide WG3 is referred to as a third port, the power combiner/distributor 103 either distributes a power inputted from the first port #1 to the second port #2 and the third port #3 or combines powers inputted from the second port #2 and the third port #3 and outputs it to the first port #1. The waveguides WG1, WG2, and WG3 are arranged on the same plane.

The power combiner/distributor 103 is formed with a branching resonant cavity R11 coupling to a resonant cavity R12 and a resonant cavity R13, and also to the first waveguide WG1. A resonant cavity R10 is formed between the branching resonant cavity R11 and the first waveguide WG1. Square sections at the centers of the branching resonant cavity R11 and the resonant cavity R10 are higher (thicker) than other parts, respectively. Thus, the resonant space is recessed in both top and bottom surfaces. In this manner, as described in the second embodiment, the resonator can be formed to have an appropriately large plan dimension.

Moreover, the power combiner/distributor 103 is formed with a resonant cavity R22 coupling to the second waveguide WG2 and a resonant cavity R33 coupling to the third waveguide WG3. The resonant cavity R22 and the waveguide WG2 configure a first transmission path, and the resonant cavity R33 and the waveguide WG3 configure a second transmission path.

Moreover, the power combiner/distributor 103 is formed with a resonant cavity R23 coupling to the second waveguide WG2 and the third waveguide WG3, for resonating within an operation frequency band, and includes a resistor Re arranged within the resonant cavity R23. The resonant cavity R23 and the resonant Re configure a power losing resonator. The power losing resonator attenuates a signal that is to be propagated from the second waveguide WG2 to the third waveguide WG3 or from the third waveguide WG3 to the second waveguide WG2 via an iris Ir.

The resonant cavity R10 functions as a band passing filter, and an attenuation amount outside a selected band increases.

Figure 14:
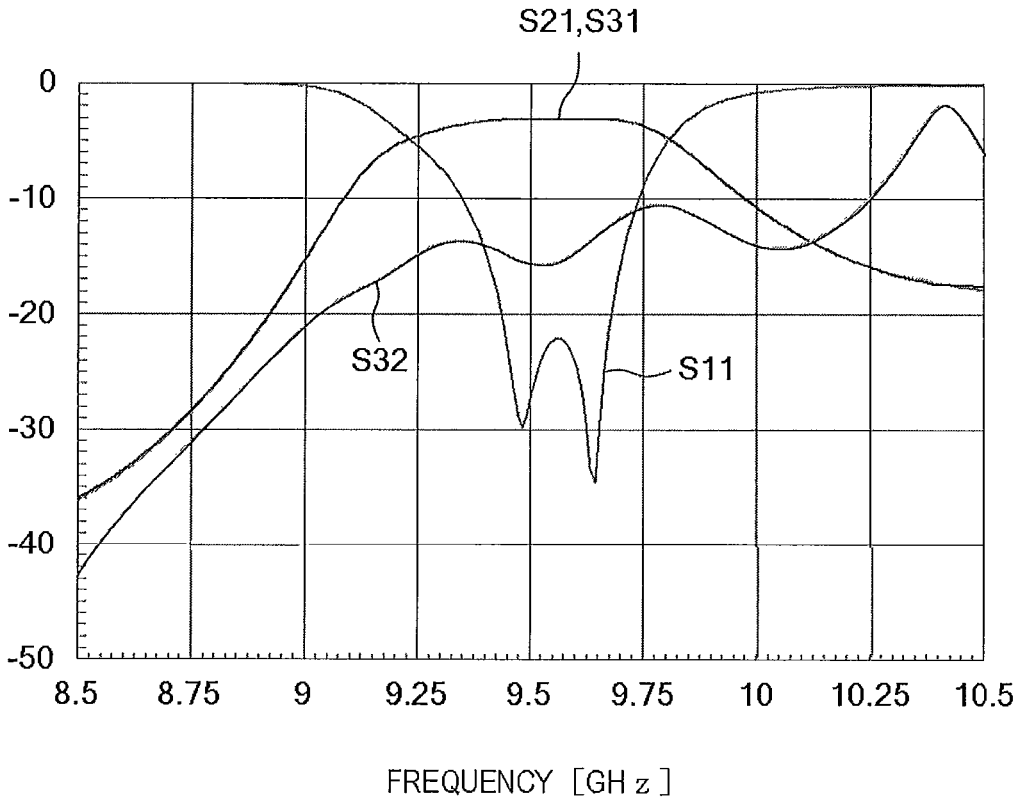
FIG. 14 is a graph illustrating frequency properties of the power combiner/distributor 103.

FIG. 14 is a graph illustrating frequency properties of the power combiner/distributor 103. Here, S11 indicates a reflection property seen from the port #1. S21 indicates a passing property (distributive property) from the port #1 to the port #2, and S31 indicates a passing property (distributive property) from the port #1 to the port #3. S32 indicates a passing property (decoupling property) from the port #2 to the port #3. The power combiner/distributor 103 is formed into a symmetric shape with respect to an electromagnetic wave propagation direction of the waveguide WG1, and thus, S21 and S31 have the same property. Thus, it can be seen that the input from the port #1 is equally distributed to the ports #2 and #3. Moreover, the isolation between the ports #2 and #3 is −15 dB at 8.5 GHz, and a sufficient decoupling property is obtained.

Fourth Embodiment

Figure 15:
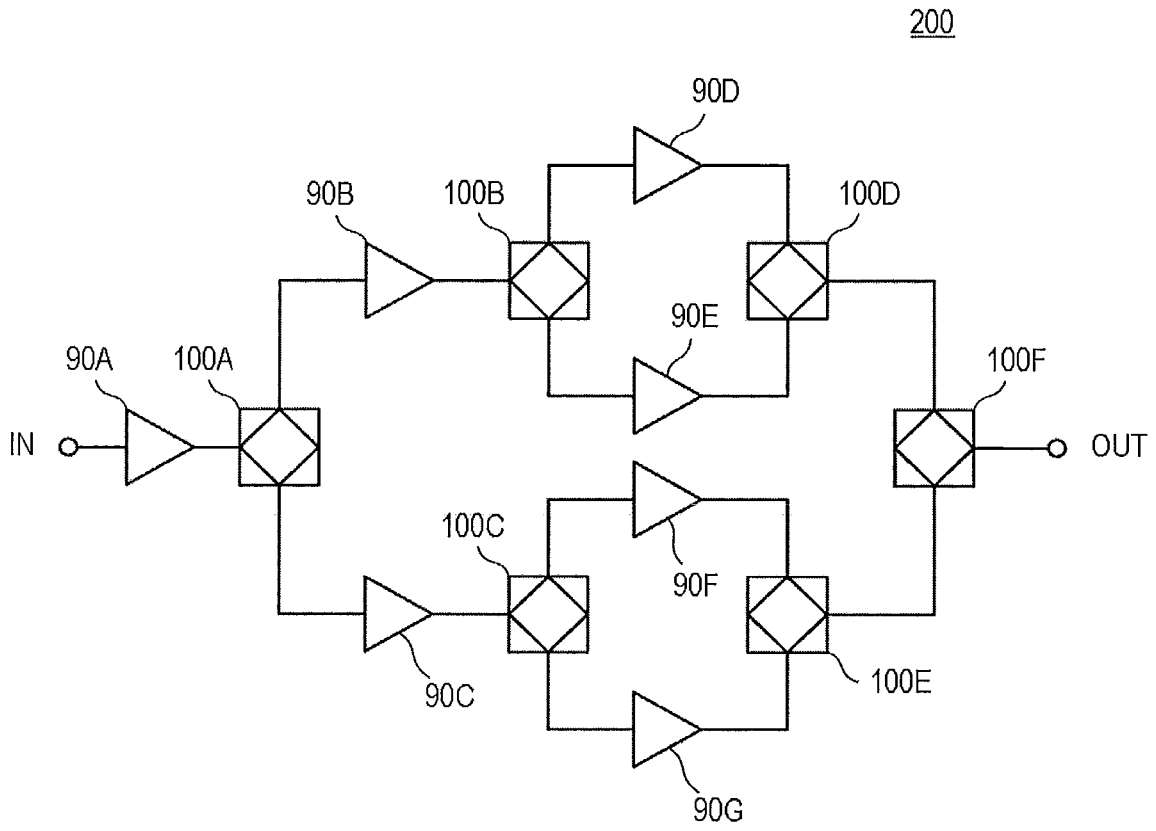
FIG. 15 is a circuit diagram of a high frequency power amplifying circuit 200 according to a fourth embodiment of the present invention.

FIG. 15 is a circuit diagram of a high frequency power amplifying circuit 200 of a fourth embodiment. The high frequency power amplifying circuit 200 includes a plurality of amplifiers 90A to 90G and a plurality of power combiner/distributors 100A to 100F, a high frequency signal inputted from an input port IN is amplified in power to be outputted to an output port OUT.

The power combiner/distributor 100A equally distributes an output signal from the amplifier 90A. The amplifiers 90B and 90C amplify the equally distributed signal. The power combiner/distributor 100B equally distributes an output signal from the amplifier 90B. Similarly, the power combiner/distributor 100C equally distributes an output signal from the amplifier 90C. The amplifiers 90D and 90E amplify the signal equally distributed by the power combiner/distributor 100B. Similarly, the amplifiers 90F and 90G amplify the signal equally distributed by the power combiner/distributor 100C. The power combiner/distributor 100D combines the output signals from the amplifiers 90D and 90E, and the power combiner/distributor 100E combines the output signals from the amplifiers 90F and 90G. The power combiner/distributor 100F combines the output signals from the power combiner/distributors 100D and 100E.

Thus, by distributing and amplifying the power in the first half of the circuit and combining the power with another in the later half of the circuit, a large power amplification is available as a whole circuit. Because each power combiner/distributor equally distributes the power in the same phase, no phase shifter for phase adjustment is required, and a wide band property can be obtained without causing a distribution phase variation.

Fifth Embodiment

In a fifth embodiment of the present invention, a radar apparatus is described as an example of a wireless apparatus in the claims.

Figure 16:
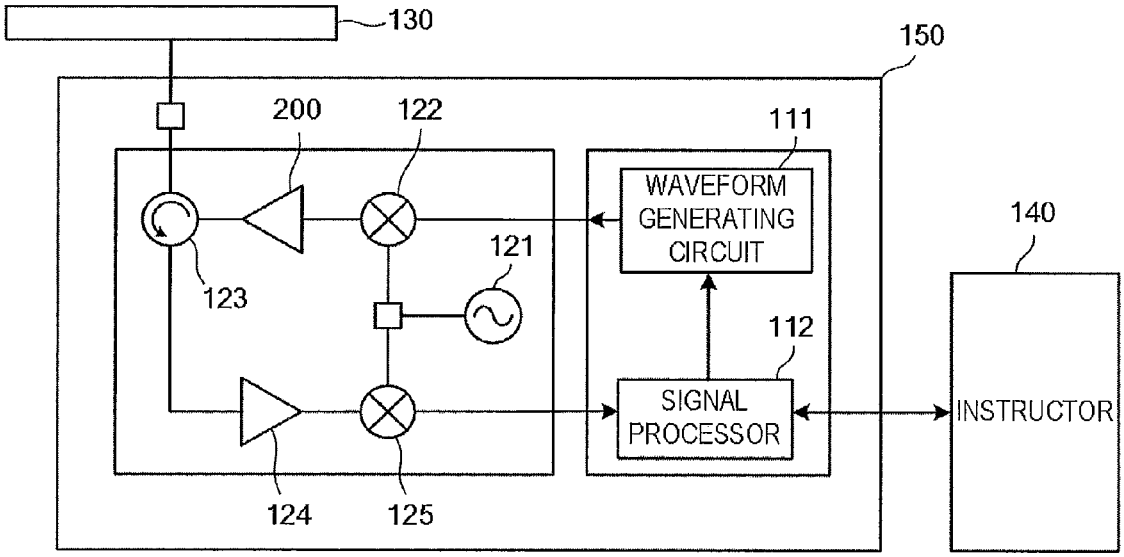
FIG. 16 is a block diagram illustrating a configuration of a radar apparatus according to a fifth embodiment of the present invention.
Figure 17A:
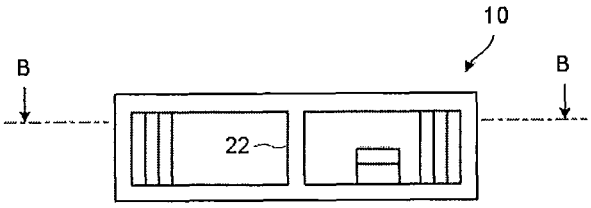
FIG. 17A (Conventional Art)
FIG. 17A is a cross-sectional view of a hybrid coupler 10 disclosed in JP2592476B.
Figure 17B:
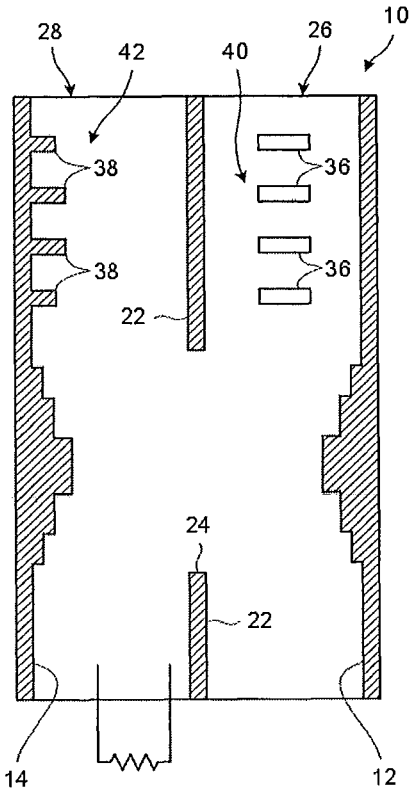
FIG. 17B (Conventional Art)
FIG. 17B is a cross-sectional plan view taken along a line B-B in FIG. 17A.

FIG. 16 is a block diagram illustrating a configuration of the radar apparatus according to the fifth embodiment. The radar apparatus includes a radiator 130, an antenna device 150, and an instructor 140. The antenna device 150 includes a waveform generating circuit 111, a signal processor 112, a local oscillator 121, mixers 122 and 125, a power amplifying circuit 200, a circulator 123, and a low noise amplifier 124.

The waveform generating circuit 111 generates a waveform of a transmission wave. The waveform (signal) is mixed with a signal of the local oscillator 121 by the mixer 122, and is amplified in power by the power amplifying circuit 200. The power amplifying circuit 200 corresponds to the power amplifying circuit 200 described in the fourth embodiment. The transmission signal passes the circulator 123 and is radiated from the radiator 130. A reception signal is received by the radiator 130, passes the circulator 123, and is amplified by the low noise amplifier 124. The reception signal is further mixed with the signal from the local oscillator 121 by the mixer 125, and is inputted into the signal processor 112.

Thus, the power combiner/distributor can be applied to the power amplifying circuit 200 included in a generating circuit of transmission waves.

Note that, "the waveguide" according to the embodiments is not limited to a hollow waveguide, and may be a dielectric body waveguide of which an electromagnetic wave propagation path is filled with inductive dielectric body(s) other than air.

In the foregoing specification, specific embodiments of the present invention have been described. However, one of ordinary skill in the technique appreciates that various modifications and changes can be performed without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A power combiner/distributor including first, second, and third waveguides connected with each other in a planar shape, and for either one of distributing power inputted from the first waveguide to the second and third waveguides and combining powers inputted from the second and third waveguides to input the combined power to the first waveguide, the power combiner/distributor comprising:

a branch circuit connected with the first waveguide and configured to branch a transmission path formed in the first waveguide into first and second transmission paths; and decoupling circuits connected with the branch circuit and also to the second and third waveguides, respectively, the decoupling circuits having a power losing resonator coupled to the second and third waveguides, resonating within an operation frequency band, and causing a power loss.

2. The power combiner/distributor of claim 1, wherein the power losing resonator includes a resistor configured to act on either one of an electric field and a magnetic field in the first, second and third waveguides to cause the loss, or includes the resistor and a resonant cavity.

3. The power combiner/distributor of claim 1, wherein the first transmission path is connected between the power losing resonator and the second waveguide and formed with at least one resonant cavity coupled to the power losing resonator and the second waveguide, and wherein the second transmission path is connected between the power losing resonator and the third waveguide and formed with at least one resonant cavity coupled to the power losing resonator and the third waveguide.

4. The power combiner/distributor of claim 1, wherein the branch circuit is formed with a resonant cavity connected with the first transmission path and coupled to a branching resonant cavity, and another resonant cavity connected with the second transmission path and coupled to the branching resonant cavity.

5. The power combiner/distributor of claim 1, wherein an electromagnetic wave that propagates in the second waveguide has the same phase as an electromagnetic wave that propagates in the third waveguide, coupling degrees of the power losing resonator with the second and third waveguides and a Q value of the power losing resonator are determined so that an amount of the electromagnetic wave that leaks from the second waveguide to the third waveguide and an amount of the electromagnetic wave that leaks from the third waveguide to the second waveguide are −10 dB or below, respectively.

6. A power amplifying circuit, comprising the power combiner/distributor of claim 1, the combiner/distributor configuring either one of a power distributor to distribute an input signal to a plurality of power amplifiers and a power combiner to combine output signals from a plurality of power amplifiers.

7. A wireless apparatus, comprising a circuit configured to distribute or combine communication signals and provided with the power combiner/distributor of claim 1.

* * * * *